US007802635B2

(12) United States Patent
Leduc et al.

(10) Patent No.: US 7,802,635 B2
(45) Date of Patent: Sep. 28, 2010

(54) DUAL STRIPPER RUBBER CARTRIDGE WITH LEAK DETECTION

(75) Inventors: Trung Leduc, Houston, TX (US); Russell Lewis, Humble, TX (US)

(73) Assignee: Smith International, Inc., Houston, TX (US)

( * ) Notice: Subject to any disclaimer, the term of this patent is extended or adjusted under 35 U.S.C. 154(b) by 251 days.

(21) Appl. No.: 11/954,266

(22) Filed: Dec. 12, 2007

(65) Prior Publication Data

US 2009/0152006 A1 Jun. 18, 2009

(51) Int. Cl.
*E21B 21/08* (2006.01)

(52) U.S. Cl. ..... 175/48; 166/113; 277/324; 73/152.22; 73/152.51

(58) Field of Classification Search ..... 175/48; 166/250.08, 113; 277/343, 324, 335; 73/152.22, 73/152.36, 152.51, 40
See application file for complete search history.

(56) References Cited

U.S. PATENT DOCUMENTS 3,387,851 A 6/1968 Cugini
4,714,865 A * 12/1987 Chin et al. ..... 318/563
4,857,842 A * 8/1989 Sturman et al. ..... 324/225
2006/0037782 A1* 2/2006 Martin-Marshall ..... 175/40

FOREIGN PATENT DOCUMENTS

GB 2195768 * 4/1988
GB 2416789 A 2/2006

OTHER PUBLICATIONS

UK IPO search report pertaining to UK patent application # 0822714.2 dated May 29, 2009. (3 pages).

* cited by examiner

*Primary Examiner*—Jennifer H Gay
*Assistant Examiner*—Sean D Andrish
(74) *Attorney, Agent, or Firm*—Osha Liang LLP

(57) ABSTRACT

A rotating control drilling device includes an upper sealing element and a lower sealing element positioned around a drillstring and forming a chamber therebetween and a leak detection device. The leak detection device includes a piston in communication with the chamber, a magnet disc disposed on an end of the piston, and a plurality of magnetic sensors arranged in a magnetic sensing ring around the rotating control drilling device. Upon reaching a selected critical pressure in the chamber, a spring is configured to compress as the magnet disc is positioned proximate to the plurality of magnetic sensors. Furthermore, a method to detect leaks in a rotating control device includes positioning a leak detection device in communication with a chamber located between upper and lower sealing elements and signaling with the leak detection device when a pressure of the chamber exceeds a selected critical pressure.

8 Claims, 3 Drawing Sheets

DUAL STRIPPER RUBBER CARTRIDGE WITH LEAK DETECTION

BACKGROUND

1. Field of the Disclosure

Embodiments disclosed herein relate generally to apparatus and methods for wellbore drilling. More particularly, the present disclosure relates to apparatus and methods for leak detection in a rotating control drilling device.

2. Background Art

Wellbores are drilled deep into the earth's crust to recover oil and gas deposits trapped in the formations below. Typically, these wellbores are drilled by an apparatus that rotates a drill bit at the end of a long string of threaded pipes known as a drillstring. Because of the energy and friction involved in drilling a wellbore in the earth's formation, drilling fluids, commonly referred to as drilling mud, are used to lubricate and cool the drill bit as it cuts the rock formations below. Furthermore, in addition to cooling and lubricating the drill bit, drilling mud also performs the secondary and tertiary functions of removing the drill cuttings from the bottom of the wellbore and applying a hydrostatic column of pressure to the drilled wellbore.

Typically, drilling mud is delivered to the drill bit from the surface under high pressures through a central bore of the drillstring. From there, nozzles on the drill bit direct the pressurized mud to the cutters on the drill bit where the pressurized mud cleans and cools the bit. As the fluid is delivered downhole through the central bore of the drillstring, the fluid returns to the surface in an annulus formed between the outside of the drillstring and the inner profile of the drilled wellbore. Because the ratio of the cross-sectional area of the drillstring bore to the annular area is relatively low, drilling mud returning to the surface through the annulus do so at lower pressures and velocities than they are delivered. Nonetheless, a hydrostatic column of drilling mud typically extends from the bottom of the hole up to a bell nipple of a diverter assembly on the drilling rig. Annular fluids exit the bell nipple where solids are removed, the mud is processed, and then prepared to be re-delivered to the subterranean wellbore through the drillstring.

As wellbores are drilled several thousand feet below the surface, the hydrostatic column of drilling mud serves to help prevent blowout of the wellbore as well. Often, hydrocarbons and other fluids trapped in subterranean formations exist under significant pressures. Absent any flow control schemes, fluids from such ruptured formations may blow out of the wellbore like a geyser and spew hydrocarbons and other undesirable fluids (e.g., $H_2S$ gas) into the atmosphere. As such, several thousand feet of hydraulic "head" from the column of drilling mud helps prevent the wellbore from blowing out under normal conditions.

However, under certain circumstances, the drill bit will encounter pockets of pressurized formations and will cause the wellbore to "kick" or experience a rapid increase in pressure. Because formation kicks are unpredictable and would otherwise result in disaster, flow control devices known as blowout preventers ("BOPs"), are mandatory on most wells drilled today. One type of BOP is an annular blowout preventer. Annular BOPs are configured to seal the annular space between the drillstring and the inside of the wellbore. Annular BOPs typically include a large flexible rubber packing unit of a substantially toroidal shape that is configured to seal around a variety of drillstring sizes when activated by a piston. Furthermore, when no drillstring is present, annular BOPs may even be capable of sealing an open bore. While annular BOPs are configured to allow a drillstring to be removed (i.e., tripped out) or inserted (i.e., tripped in) therethrough while actuated, they are no t configured to b e actuated during drilling operations (i.e., while the drillstring is rotating). Because of their configuration, rotating the drillstring through an activated annular blowout preventer would rapidly wear out the packing element.

As such, rotary drilling heads are frequently used in oilfield drilling operations where elevated annular pressures are present. A typical rotary drilling head includes a packing or sealing element and a bearing package, whereby the bearing package allows the sealing element to rotate along with the drillstring. Therefore, in using a rotary drilling head, there is no relative rotational movement between the sealing element and the drillstring, only the bearing package exhibits relative rotational movement. Examples of rotary drilling heads include U.S. Pat. No. 5,022,472 issued to Bailey et al. on Jun. 11, 1991 and U.S. Pat. No. 6,354,385 issued to Ford et al. on Mar. 12, 2002, both assigned to the assignee of the present application, and both hereby incorporated by reference herein in their entirety. In some instances, dual stripper rotating control devices having two sealing elements, one of which is a primary seal and the other a backup seal, may be used. As the assembly of the bearing package along with the sealing elements and the drillstring rotate, leaks may occur between the drillstring and the primary sealing element. An apparatus or method of detecting leaks between the drillstring and sealing element while drilling would be well received in the industry.

SUMMARY OF THE DISCLOSURE

In one aspect, embodiments disclosed herein relate to a method to detect leaks in a rotating control device, the method including positioning a leak detection device in communication with a chamber located between an upper sealing element and a lower sealing element of the rotating control device and signaling with the leak detection device when a pressure of the chamber exceeds a selected critical pressure.

In another aspect, embodiments disclosed herein relate to a rotating control drilling device including a seal assembly rotatable with respect to a housing, wherein the seal assembly comprises an upper seal element and a lower seal element and the upper and lower sealing elements are axially spaced to form a chamber therebetween, and a detection device. The detection device includes a piston assembly disposed in the seal assembly and in communication with the chamber, a magnet disc disposed on an end of the piston, and a plurality of magnetic sensors arranged in the housing axially proximate to the magnet disc of the piston assembly, wherein the plurality of magnetic sensors are configured to indicate a selected critical property in the chamber when the piston assembly is thrust toward the magnetic sensors.

In another aspect, embodiments disclosed herein relate to a method to detect leaks in a rotating control drilling device including operating the rotating control drilling device comprising a chamber formed between an upper sealing element and a lower sealing element, monitoring a pressure in the chamber, closing a distance between a magnet disc and a magnetic sensor to a critical distance, wherein the critical distance indicates a leak, and transmitting a warning signal to a rig floor operator to indicate the leak.

In another aspect, embodiments disclosed herein relate to a rotating control drilling device including an upper sealing element and a lower sealing element positioned around a drillstring and forming a chamber therebetween and a leak detection device. The leak detection device includes a piston disposed within a bore in the rotating control drilling device and in communication with the chamber, a magnet disc disposed on an end of the piston, and a plurality of magnetic sensors arranged in a magnetic sensing ring around the rotating control drilling device, wherein, upon reaching a selected critical pressure in the chamber, a spring is configured to compress as the magnet disc is positioned proximate to the plurality of magnetic sensors.

Other aspects and advantages of the invention will be apparent from the following description and the appended claims.

DETAILED DESCRIPTION

In one aspect, embodiments disclosed herein relate to apparatus and methods for wellbore drilling. More particularly, the present disclosure relates to apparatus and methods for leak detection in a dual stripper rotating control drilling device.

Figure 1:
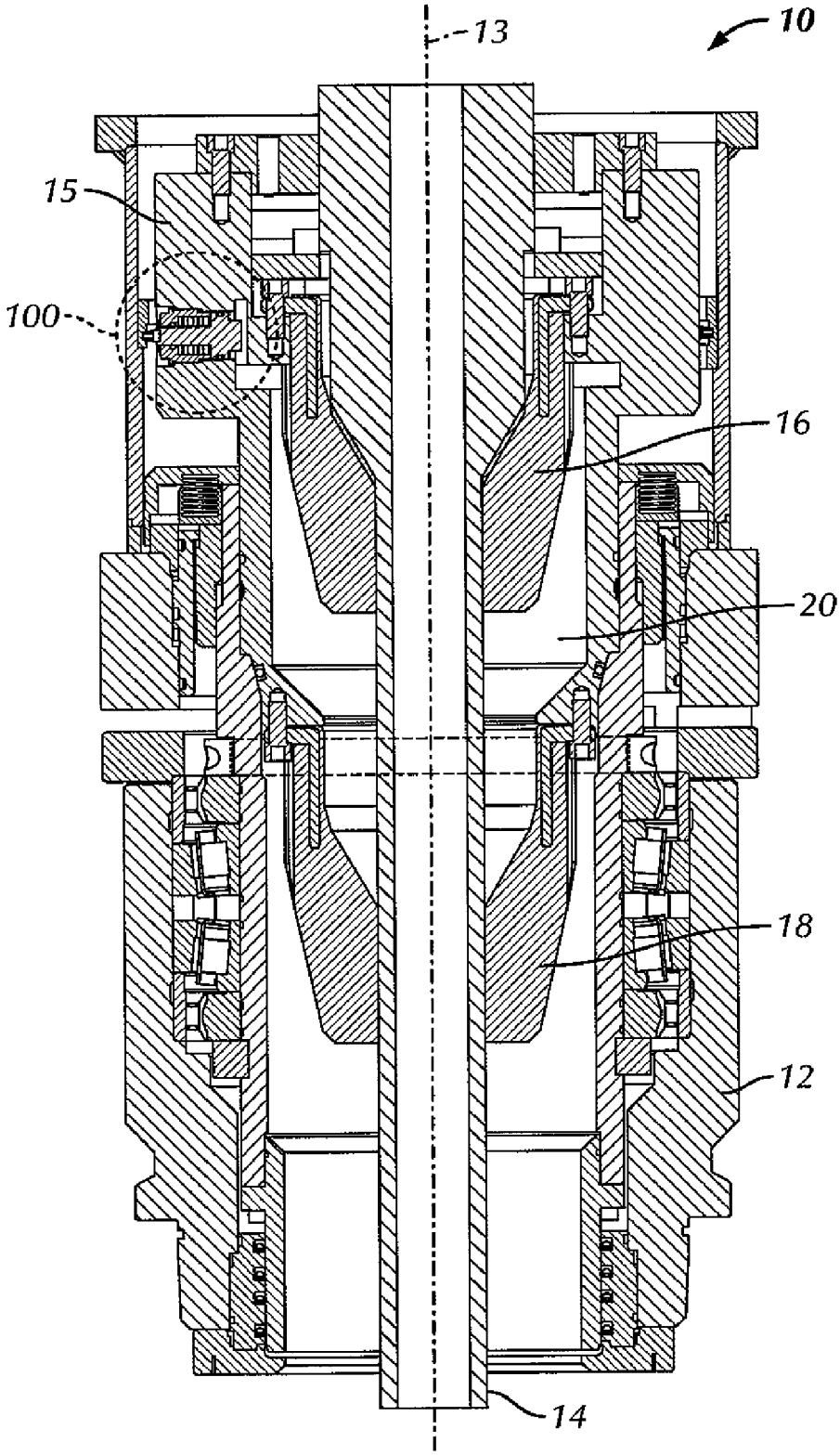
FIG. 1 is a section view of a rotating control drilling device with a leak detection device in accordance with embodiments of the present disclosure.

Referring to FIG. 1, a section view of a rotating control drilling device 10 is shown in accordance with embodiments of the present disclosure. Rotating control drilling device 10 includes a body 12 having a central axis 13 through which a drillstring 14 passes. An upper sealing element 16 and a lower sealing element 18 seal about drillstring 14 forming a chamber 20 therebetween. Chamber 20 may trap pressure between upper sealing element 16 and lower sealing element 18. Further, rotating control device 10 includes a bearing package 15 within body 12 which allows upper sealing element 16 and lower sealing element 18 to rotate about central axis 13 along with drillstring 14 during operation.

Rotating control drilling device 10 further includes a leak detection device 100. During operation of rotating control drilling device 10, leaks may occur between drillstring 14 and lower sealing element 18 and cause pressure to build in chamber 20 between upper sealing element 16 and lower sealing element 18. When a "critical pressure" is reached in chamber 20, it may be advantageous to receive an indication of such a critical pressure, which may suggest that lower sealing element 18 is leaking and needs to be replaced. As used herein, critical pressure may be defined as a pressure in chamber 20 indicating a leak between lower sealing element 18 and drillstring 14. The critical pressure may be determined and understood by a person skilled in the art.

Figure 2:
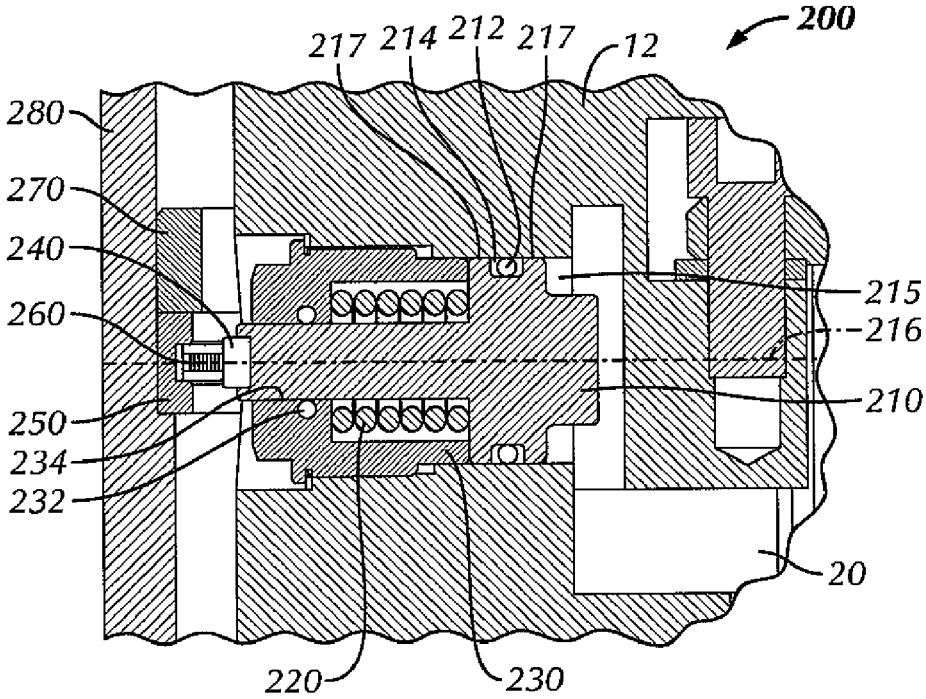
FIG. 2 is a section view of the leak detection device in accordance with embodiments of the present disclosure.

Referring now to FIG. 2, a section view of a leak detection device 200 as installed in rotating control drilling device body 12 is shown in accordance with embodiments of the present disclosure. Leak detection device 200 includes a piston 210 disposed within a bore 215. Bore 215 may be configured at an outer circumference of rotating control drilling device body 12 and along a central axis 216 which is perpendicular to and extends radially with respect to central axis 13 (from FIG. 1) of rotating control drilling device 10 (FIG. 1). An O-ring 212 and backup ring 214 may be included about piston 210 to seal with a contact area 217 between an inner surface of bore 215 and an outer surface of piston 210. Contact area 217 may be relatively smooth to allow O-ring 212 to seal, or configured as otherwise known to those skilled in the art.

Still referring to FIG. 2, leak detection device 200 further includes a spring 220 disposed on piston 210, and a valve cap 230 into which the subassembly of piston 210 and spring 220 may fit. An O-ring 232 is included to seal a contact area 234 between an outer surface of piston 210 and an inner surface of valve cap 230. Valve cap 230 may be threadably secured in rotating control drilling device body 12 or by any other method known to those skilled in the art. Further, a magnet disc 240 is disposed on an outward facing end of piston 210. Magnet disc 240 may be fastened to piston with epoxy, fasteners, or other attachment mechanisms known to those skilled in the art.

Leak detection device 200 further includes a magnetic sensing ring 260 attached to an aluminum ring 250 positioned inside a bore of the rotating control drilling device 10 (FIG. 1). Magnetic sensing ring 260 is oriented such that a centerline of ring 260 is coincident with central axis 216 of bore 215, thereby allowing magnetic sensing ring 260 and magnet disc 240 to be substantially even with each other. Magnetic sensing ring 260 may be sealed with an epoxy compound or other sealing compound known to those skilled in the art for protection from hazardous environments. A retaining ring 270 and a safety shroud 280 further secure aluminum ring 250 and magnetic sensing ring 260 in rotating control drilling device body 12.

Figure 3:
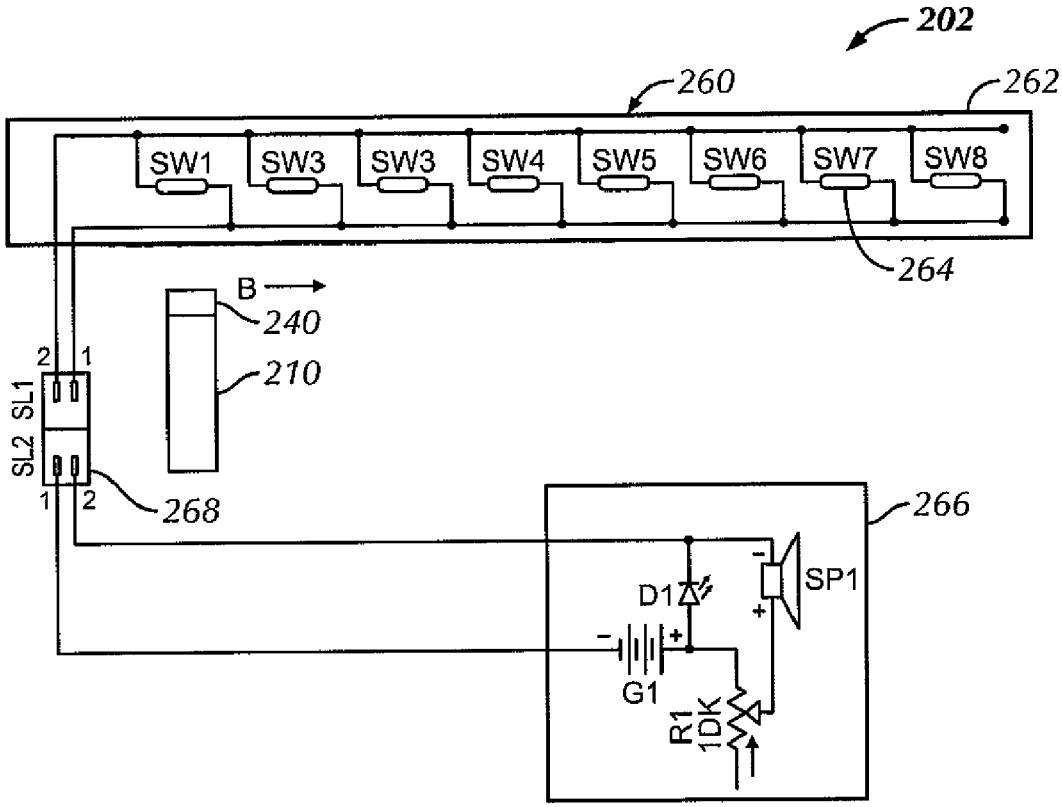
FIG. 3 is a schematic view of a magnetic sensing ring in accordance with embodiments of the present disclosure.

Referring now to FIG. 3, an electrical schematic of a leak detection system 202 is shown in accordance with embodiments of the present disclosure. Leak detection system 202 includes a wiring circuit 262, multiple magnetic sensors 264 spaced around a circumference of magnetic sensing ring, and electrical components 266, 268 known to those skilled in the art. FIG. 3 shows piston 210 with magnet disc 240 in relation to magnetic sensors 264. As bearing package 15 (from FIG. 1) rotates inside rotating control drilling device 10 (from FIG. 1), magnet disc 240 continuously passes (shown by arrow "B") by the multiple magnetic sensors 264 in magnetic sensing ring 260. The number and spacing of magnetic sensors (e.g., Hall Effect sensors) 264 arranged around the circumference of the rotating control drilling device in magnetic sensing ring 260 may be determined by a person skilled in the art. For example, the speed in revolutions per minute that the bearing package rotates may determine the number of magnetic sensors 264 used and/or the amount of spacing between magnetic sensors 264

Referring back to FIG. 2, spring 220 is configured to correspond to a selected "critical" pressure in chamber 20 between upper and lower sealing elements (16 and 18 from FIG. 1). Spring 220 has a "spring constant," which is a measure of "stiffness" or resistance of the spring. Calculations and methods used for selecting an appropriate spring constant would be understood by a person skilled in the art. The spring constant of spring 220 may correspond to the selected critical pressure in chamber 20 such that, as the pressure approaches the selected critical level, spring 220 also compresses a known amount.

When the pressure in chamber 20 has reached a predetermined or critical pressure level, spring 220 will also have compressed and moved magnet disc 240 within a "critical distance" of magnetic sensing ring 260. As used herein, "critical distance" may be defined as the distance between magnet disc 240 and magnetic sensing ring 260 when a warning signal is sent to a rig floor operator indicating a critical pressure in chamber 20. In certain embodiments, the critical pressure in chamber 20 may be about 200 psi. In further embodiments, the critical pressure in chamber 20 may be between about 100 psi and about 500 psi. Embodiments of the present disclosure conform to meet requirements specified by the American Petroleum Institute in their guideline API 16RCD, which relates to monitoring pressure between two sealing elements, and is incorporated by reference herein.

Figure 4A:
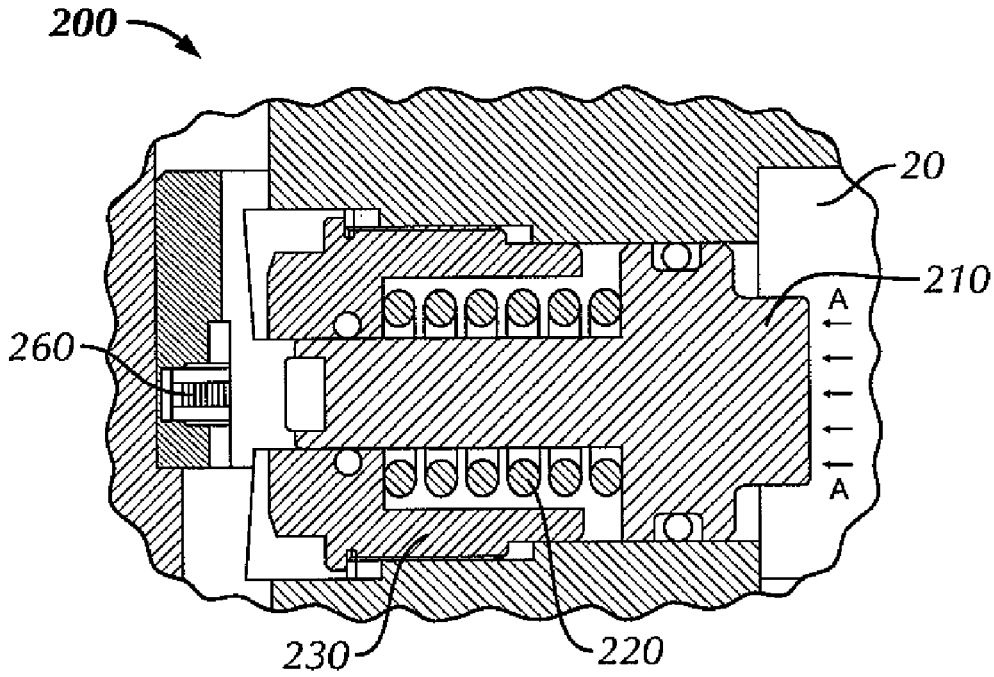
FIG. 4A is a section view of the leak detection device with pressure in a chamber below a critical pressure in accordance with embodiments of the present disclosure.

Now referring to FIG. 4A, a section view of leak detection device 200 is shown at a state when pressure in chamber 20 has not reached the critical pressure. Spring 220 is initially uncompressed, or biased to keep magnet disc 240 at a distance greater than the critical distance from magnetic sensing ring 260. As pressure (shown by arrows "A") increases in chamber 20 between upper sealing element 16 (FIG. 1) and lower sealing clement 18 (FIG. 1), the pressure forces piston 210 and magnet disc 240 to move radially outward toward magnetic sensing ring 260 causing spring 220 to compress.

Figure 4B:
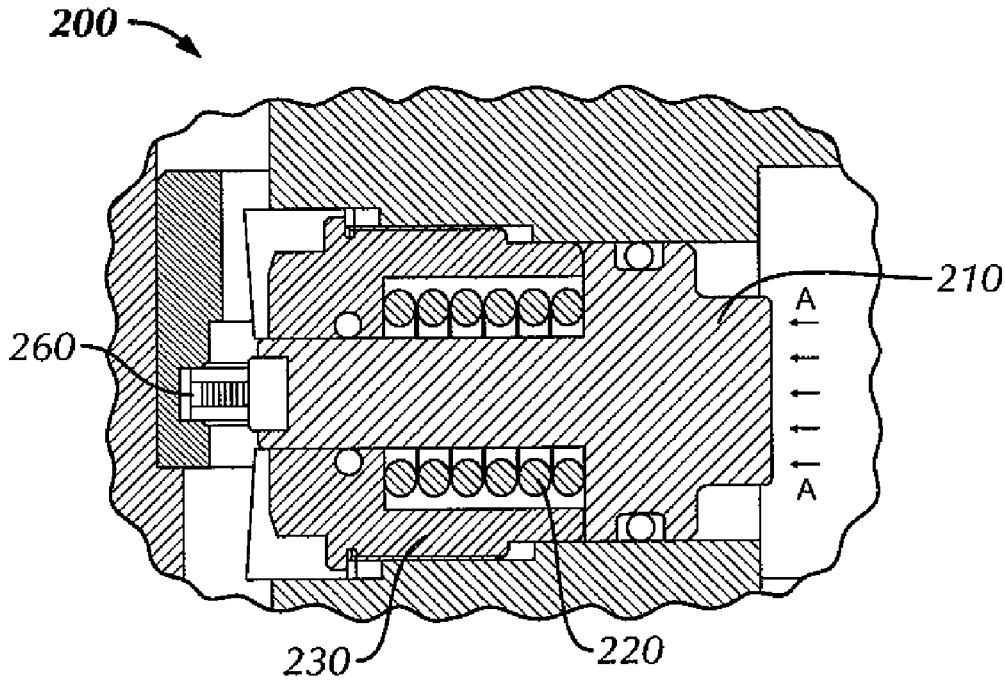
FIG. 4B is a section view of the leak detection device with pressure in a chamber at or above a critical pressure in accordance with embodiments of the present disclosure.

Referring to FIG. 4B, a section view of leak detection device 200 is shown at a state when the pressure in chamber 20 has reached the critical pressure. The pressure applied on piston 210 (shown by arrows "A") has forced piston 220 and magnet disc 240 to move radially outward towards magnetic sensing ring 260, causing spring 220 to become compressed, and allowing magnet disc 240 to move within the critical distance of magnetic sensing ring 260. Magnetic sensors 264 in magnetic sensing ring 260 detect the critical distance between themselves and magnet disc 240 which indicates the critical pressure has been reached in chamber 20. The close proximity of magnet disc 240 to magnetic sensing ring 260 at the critical distance may cause a signal to be transmitted to the rig floor operator indicating the critical pressure. A warning indicator on a control panel on the rig floor may be in the form of a blinking light, beeping horn, or other warning signals known to those skilled in the art. In certain embodiments, the warning signal may be transmitted wirelessly to the rig floor operator.

In certain embodiments, the upper sealing element and lower sealing element may be contained in a cartridge style system as a single unit. The cartridge system may work with existing clamping mechanisms for installation into an existing bearing assembly of the rotating control drilling device. The cartridge style system of the sealing elements may allow the sealing elements to be changed independent of the bearing assembly. Rotating control drilling device clamping mechanisms and bearing assemblies are described in detail in U.S. patent application Ser. No. 11/556,938, assigned to the assignee of the present invention, and hereby incorporated by reference in its entirety.

In certain embodiments, a software program may be used with the leak detection device to manage the data received from the magnetic sensors. Initially, when starting the program, a diagnostics test may be run to verify the system. During operation, the software program may be configured to recognize the distance as it changes between the magnet disc and the magnetic sensors, and to recognize the critical distance between the magnet disc and the magnetic sensors and know when to transmit a signal to the rig floor operator.

Further, a time delay may be integrated into the software package. The time delay may ensure that the magnet disc is at the critical distance from the magnetic sensors for a given amount of time before a warning signal is transmitted. In certain embodiments, the time delay may be about 15 seconds. In alternate embodiments, the time delay may range from about 5 seconds to about 30 seconds. The time delay may provide that pressure "spikes" are not sufficient to cause a warning signal to be transmitted, but rather, a constant critical pressure is required before a warning signal is sent. Further, the magnet disc may be configured to have a south pole facing outward, or towards the magnetic sensors in the magnetic sensing ring. Orientation of the magnet disc in such a way will be understood by a person skilled in the art.

Advantageously, embodiments of the present disclosure for the leak detection device may provide an early warning indication to a rig floor operator that a sealing element in the rotating control drilling device is leaking and needs to be replaced. When a primary sealing element leaks, the rig floor personnel is alerted and may take proactive steps to prevent costly repairs caused by sealing elements failing without warning. In the past, as the drillstring was raised, the operator relied more on a sight and sound method of listening for pressure leaks as they made a "burping" sound. The leak detection device enhances the operation of a dual stripper rubber system and improves the functional and sealing effect of the rotating control drilling device.

Further, embodiments of the present disclosure may provide a system that is easy to install and remove with existing clamping mechanisms used in the rotating control drilling devices. The leak detection device may be retrofitted on existing equipment which is significantly less expensive than acquiring new equipment with the new technology.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A rotating control drilling device comprising:

an upper sealing element and a lower sealing element positioned around a drillstring and forming a chamber therebetween;

a leak detection device comprising:

a piston disposed within a bore in the rotating control drilling device and in communication with the chamber;

a magnet disc disposed on an end of the piston; and a plurality of magnetic sensors arranged in a magnetic sensing ring around the rotating control drilling device;

wherein, upon reaching a selected critical pressure in the chamber, a spring is configured to compress as the magnet disc is positioned proximate to the plurality of magnetic sensors.

2. The rotating control drilling device of claim 1 wherein the spring is configured to thrust the piston assembly away from the magnetic sensors in the absence of the selected critical pressure.

3. The rotating control drilling device of claim 1, wherein the selected critical pressure is between about 100 psi and about 500 psi.

4. The rotating control drilling device of claim 1, wherein the selected critical pressure is about 200 psi.

5. The rotating control drilling device of claim 1, wherein the plurality of magnetic sensors comprise Hall Effect sensors.

6. The rotating control drilling device of claim 1, wherein the magnet disc comprises at least one rare earth magnet.

7. The rotating control drilling device of claim 1, wherein the magnet disc is configured to have a south pole facing the magnetic sensing ring.

8. The rotating control drilling device of claim 1, wherein the spring is selected for the selected critical pressure.

* * * * *

UNITED STATES PATENT AND TRADEMARK OFFICE

CERTIFICATE OF CORRECTION

PATENT NO. : 7,802,635 B2
APPLICATION NO. : 11/954266
DATED : September 28, 2010
INVENTOR(S) : Trung Leduc et al.

It is certified that error appears in the above-identified patent and that said Letters Patent is hereby corrected as shown below:

In The Claims:

In Claim 2, Column 6, line 48, the words “the piston assembly away” should read --the piston away--.

Signed and Sealed this
Twenty-fifth Day of January, 2011

David J. Kappos

David J. Kappos
*Director of the United States Patent and Trademark Office*